US006283741B1

(12) United States Patent
Gustavsson et al.

(10) Patent No.: US 6,283,741 B1
(45) Date of Patent: Sep. 4, 2001

(54) DEVICE FOR SPREADING AND DISTRIBUTING PARTICLES ON A MATERIAL WEB

(75) Inventors: Lennart Gustavsson, Växjö; Lars Nilsson, Karlstad, both of (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/403,968

(22) PCT Filed: Feb. 18, 1998

(86) PCT No.: PCT/SE98/00317

§ 371 Date: Nov. 1, 1999

§ 102(e) Date: Nov. 1, 1999

(87) PCT Pub. No.: WO98/36884

PCT Pub. Date: Aug. 27, 1998

(30) Foreign Application Priority Data

Feb. 24, 1997 (SE) ..... 9700675
Aug. 29, 1997 (SE) ..... 9703135

(51) Int. Cl.[7] ..... B28B 5/02
(52) U.S. Cl. ..... 425/83.1; 425/216
(58) Field of Search ..... 425/83.1, 80.1, 425/216, 217; 264/113, 109, 112

(56) References Cited

U.S. PATENT DOCUMENTS 3,115,431 * 12/1963 Stokes et al. ..... 425/83.1
4,315,722 * 2/1982 Ufermann ..... 425/83.1
5,202,133 * 4/1993 Pesch et al. ..... 425/83.1
5,288,220 * 2/1994 Kugler et al. ..... 425/83.1
5,496,570 3/1996 Mauss et al. ..... 425/83.1
5,855,923 * 1/1999 Gustavson ..... 425/83.1
5,858,419 * 1/1999 Haeberli ..... 425/364 R

FOREIGN PATENT DOCUMENTS 973 865 6/1960 (DE) .
2919251 * 11/1980 (DE) ..... 425/83.1
SU 1315319 * 6/1987 (RU) ..... 425/83.1
7909871-1 1/1985 (SE) .
96/16776 6/1996 (WO) .

* cited by examiner

*Primary Examiner*—Nam Nguyen
*Assistant Examiner*—Thu Khanh T. Nguyen
(74) *Attorney, Agent, or Firm*—Lerner, David, Littenberg, Krumholz & Mentlik, LLP

(57) ABSTRACT

Apparatus is disclosed for spreading and distributing particles such as glue-coated wood fibers onto a moving web including rotatable axles disposed transverse to the direction of movement of the moving web with each axle including a number of distributors rotatable with the axles and disposed generally obliquely with respect to the axes of the axles, each of the axles disposed at successively increasing heights from the moving web in its direction of movement whereby each of the distributors extends into the wood fiber particles comprising the moving web and distributes the particles across the moving web.

17 Claims, 4 Drawing Sheets

DEVICE FOR SPREADING AND DISTRIBUTING PARTICLES ON A MATERIAL WEB

FIELD OF THE INVENTION

The present invention relates to apparatus for spreading and distributing particles on a material web, such as glue-coated wood fibers on a wire or a conveying belt for production of wood-fiber boards.

BACKGROUND OF THE INVENTION

In a forming station for producing wood-fiber boards there is currently a need to distribute glue-coated wood fibers on a wire or a conveying belt to form a layer with a certain thickness. The layer of wood fibers is transported by the wire or conveying belt to a pressing plant, in which the wood fibers, under the influence of pressure and temperature, are pressed together into a continuous board.

As is shown in International Application No. PCT/SE95/01402, a device of the type described above is previously known, whose purpose is the leveling of the material web after air distribution of the particles. Another type of leveling or milling is disclosed in U.S. Pat. No. 5,496,570 and consists of a scraper or a planing device, which, for the method shown, cut off any excess of the wood fibers. A disadvantage with the known technique is that a large amount of wood fibers are recirculated to the process from the leveling or milling step, which. is unfavorable, since the quality deteriorates by wear.

U.S. Pat. No. 5,496,570 shows how a number of disc rollers are used for distributing wood fibers and for pulverizing possible clumps among the wood fibers. A similar device, for distributing wood fibers with the aid of disc rollers, is shown in Swedish Patent No. 436,627. A common element in both of these latter references is that the disc rollers are located above the level of the wood fibers and by utilizing successively different distances between the discs of the different disc rollers, one may achieve sorting and orientation of the wood fibers in several different layers. A disadvantage, however, is that the distribution is unsatisfactory across the material web.

An object of the present invention is to thus provide a homogenous layer of wood fibers, having a desired distribution over the width of the material web. Another object is to provide a distribution of the wood fibers, in such way that any considerable subsequent leveling or milling is thereby avoided.

SUMMARY OF THE INVENTION

In accordance with the present invention, this and other objects have now been realized by the discovery of apparatus for spreading and distributing particles onto a moving web of the particles carried by a moving belt and moving in a predetermined direction, the apparatus comprising a plurality of rotatable axles disposed transverse to the predetermined direction, each of the plurality of rotatable axles including a plurality of distributors rotatable with the corresponding plurality of rotatable axles and disposed generally obliquely with respect to the plurality of rotatable axles, each of the plurality of rotatable axles disposed at successively increasing heights from the moving web in the predetermined direction, whereby each of the plurality of distributors extends into the particles comprising the moving web and distributes the particles across the moving web. Preferably, the particles comprise glue-coated wood fibers for production of wood fiberboard.

In accordance with one embodiment of the apparatus of the present invention, the apparatus includes a common frame, each of the plurality of rotable axles being attached to the common frame, and the common frame being disposed at a predetermined angle with respect to the moving web, whereby each of the plurality of rotatable axles provides a layer of the particles having a predetermined thickness, the predetermined thickness being determined by the predetermined angle of the common frame. In a preferred embodiment, the common frame is adjustable in a direction transverse to the predetermined direction at a predetermined transverse angle, whereby the cross-sectional profile of the particles comprising the moving web can be altered by altering the predetermined transverse angle.

In accordance with another embodiment of the apparatus of the present invention, each of the plurality of rotatable axles is individually vertically adjustably attached to the common frame, whereby the predetermined thickness of each of the layers of the particles can be adjusted.

In accordance with another embodiment of the apparatus of the present invention, each of the plurality of rotatable axles is individually longitudinally adjustably attached to the common frame, whereby the distance between the plurality of rotatable axles can be altered so as to alter the angle between the plurality of rotatable axles and the distribution of the particles within the layers.

In accordance with another embodiment of the apparatus of the present invention, at least one of the plurality of distributors comprises an elliptical disk. Preferably, the elliptical disk includes at least one opening, whereby the particles can pass therethrough. In a preferred embodiment, the elliptical disk includes a plurality of the openings, and includes at least one spoke separating the plurality of openings. Preferably, the at least one spoke is shaped in a manner whereby the particles are transported by the at least one shaped spoke in a desired direction.

In accordance with one embodiment of the apparatus of the present invention, at least one of the distributors includes transport means disposed on the periphery thereof, whereby the particles are transported in a desired direction by the transport means. Preferably, the transport means comprises protrusions.

In accordance with another embodiment of the apparatus of the present invention, at least one of the distributors comprises an elliptical disk including at least one recess, the elliptical disk formed in a manner whereby the particles are transported in a desired direction thereby.

In accordance with another embodiment of the apparatus of the present invention, at least one of the distributors comprises an elliptical disk including corrugations, whereby the particles are transported in a desired direction thereby.

In accordance with another embodiment of the apparatus of the present invention, at least one of the distributors comprises a plurality of protruding members, whereby the particles are transported in a desired direction thereby. Preferably, the protruding members are disposed in the shape of an elliptical planar brush. In a preferred embodiment, the protruding members comprises a plurality of protruding pins.

These objects of the present invention are achieved with a device which is characterized in that several axles, with distributing means, are arranged successive after each other at an increasing height, and are arranged such that the distribution means extends down into the material web, whereas particles at each axle, by the rotation of the distribution means, will be spread across the material web.

IIn a preferred embodiment of the present invention, the axles are secured to a common frame, which is arranged at an angle against the material web such that several layers are formed above each other, whereby the thickness of these layers, and thus the thickness of the resulting material web, is defined by this angle.

BRIEF DESCRIPTION OF THE DRAWINGS

The invention will now be described in detail referring to the following detailed description with reference to the accompanying drawings, in which.

DETAILED DESCRIPTION

Figure 1:
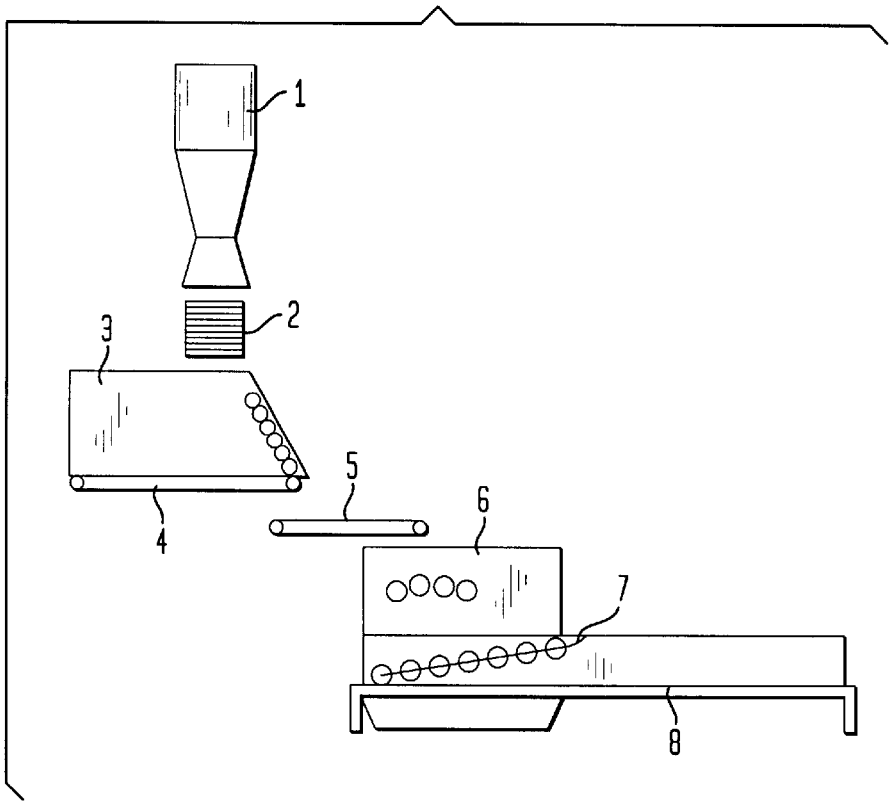
FIG. 1 is a side, elevational, schematic view of a forming station for wood fiber board.

Referring to the drawings, FIG. 1 shows a forming station for wood fiber boards, comprising a cyclone 1, for supply of glue-coated wood fibers. Wood fibers are discharged through a sluice 2 to a dosing bin 3, for dosage of wood fibers. The dosing bin 3 has means 4 for feeding wood fibers to a conveyor scale 5. After the conveyor scale 5 the wood fibers pass a spreader 6, which can be provided with wings, discs, pins or other known means for disintegrating the wood fibers and distributing them over a number of forming rollers 7. The forming rollers 7 can be adjusted to different angles, depending on the desired thickness of the layer of wood fibers. The forming rollers 7 feed wood fibers on a wire 8 or a conveyor belt for transportation to a pressing station (not shown). The drawings show how the devices for supply of wood fibers, up to the forming rollers 7, are located in line with the wire 8 or conveyor belt, but, the devices may also be located such that the supply of wood fibers are performed perpendicularly with respect to the wire 8 or conveying belt.

Figure 2:
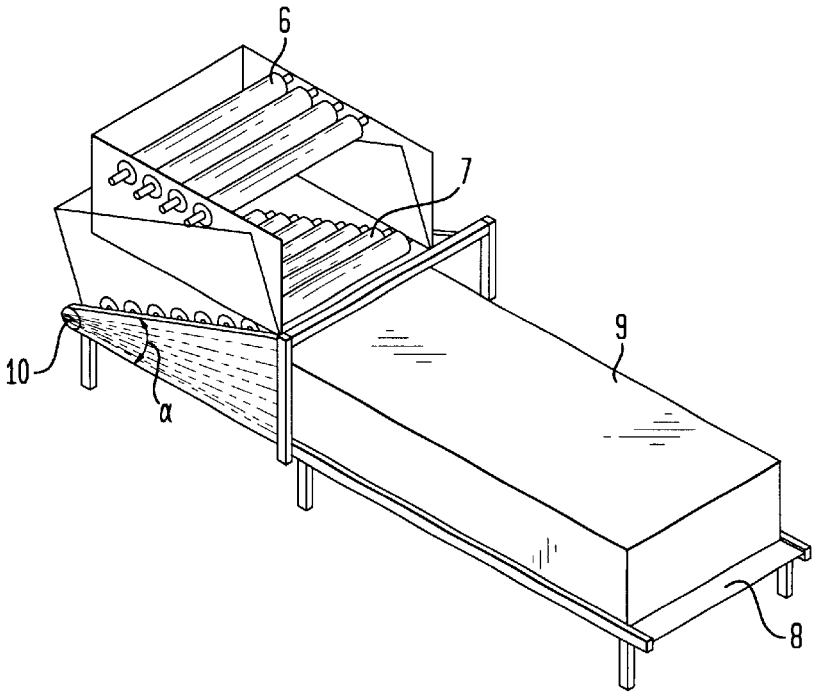
FIG. 2 is a front, perspective, schematic view of a device according to the present invention.

FIG. 2 shows a more detailed view of the spreaders 6, followed by the forming rollers 7 and the material web 9 discharged on the wire 8 or conveyor belt. The forming rollers 7 are secured to a common frame 10, which is arranged at an angle $\alpha$ with respect to the material web 9.

Figure 3:
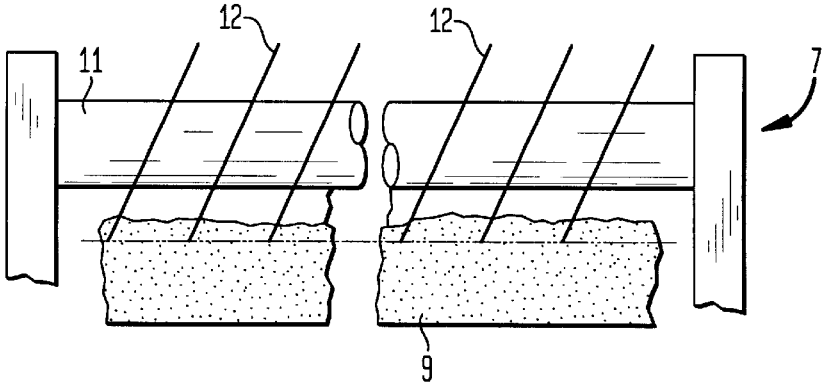
FIG. 3 is a front, elevational, partial, schematic view of a forming roller for use in accordance with the present invention.

FIG. 3 shows a forming roller 7, which is arranged transverse to the direction of movement of the material web, and comprises a rotating axle 11 and a number of distributing means 12. The distributing means 12 are located along axle 11 and consist, in a first preferred embodiment, of a number of oblique, essentially elliptical discs, or similar disc shaped means, which rotate with the axle 11. The distributing means 12 extend down into the material web 9.

The expression oblique discs also embraces discs which, in fact, are arranged straight on the axle, but which by bending or the like have at least one resulting oblique surface acting on the material web 9.

The axle 11 and the distribution means 12 can be of the type, as disclosed in International Patent Application No. PCT/SE95/01402, in which the distribution means 12 are mounted an axial distance from each other for rotation together with the axle 11, and, around its shorter diameter, are arranged obliquely in relation to the axle 11, in such a way that they have a circular axial projection. In addition, the distribution means 12 are mounted, in such a way, that the axial distance between adjacent discs overlaps each other in the axial direction, and in addition the discs are inclined at an angle of from about 45° to 80°, and preferably about 60° in relation to the axle 11. During rotation the discs 12 perform an axially backwards and forwards throwing movement of wood fibers inside a imaginary horizontal straight tube.

Figure 4:
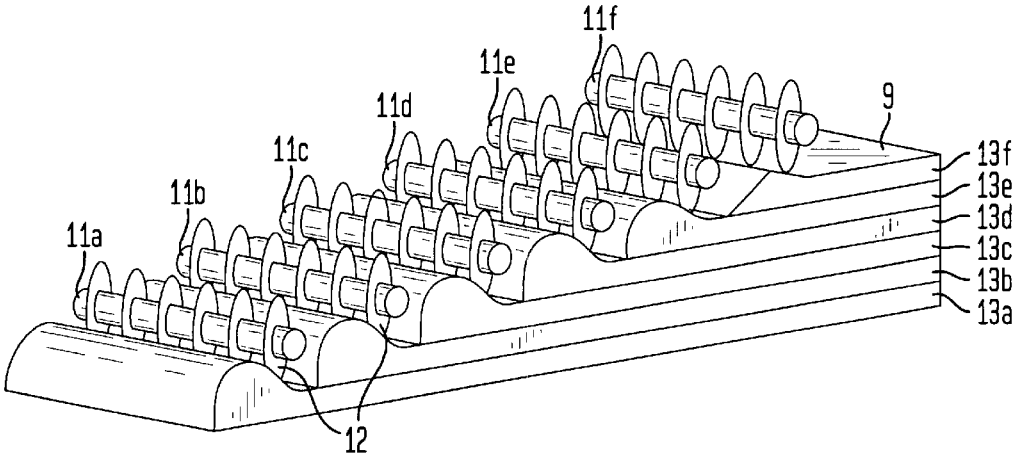
FIG. 4 is a side, perspective, schematic view of several forming rollers arranged according to the present invention.

FIG. 4 shows several axles 11*a*–11*f* arranged successively after each other at increasing heights from the bottom of the material web 9, and arranged such that the distribution means 12 of the axis project essentially down into the material web 9. Thus, the particles at each axle, 11*a*–11*f*, will, by rotation of the distribution means 12, spread across the material web 9 to an even layer, 13*a*–13*f*, of homogenous distributed particles.

Figure 5:
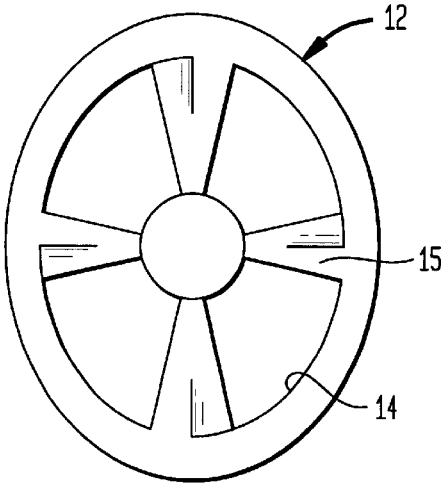
FIG. 5 is a side, elevational, schematic view of an alternative embodiment of a distribution means according to the present invention.

FIG. 5 shows a second alternative embodiment of a distributing means 12, which consists of an elliptical disc provided with openings 14, through which wood fibers can be transported. The openings 14 can be of a suitable form, but are preferably shaped like spokes 15 or similar means formed between the openings 14. The spokes 15 can also be turned or shaped in another suitable manner, such that some action by propeller is created, for transportation of wood fibers in a desired direction. The disc can also be provided with protrusions or similar means along its periphery to effect such transportation.

Figure 6:
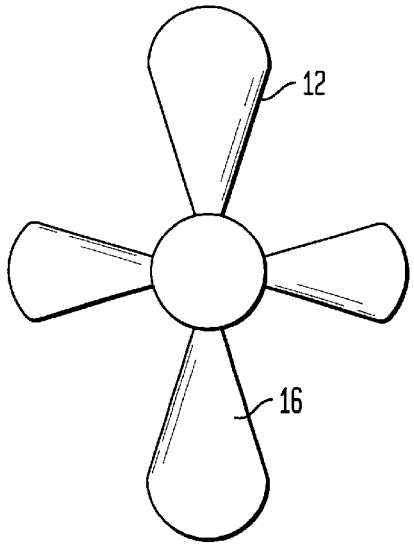
FIG. 6 is a side, elevational, schematic view of another embodiment of a distribution means according to the present invention.

FIG. 6 shows a third alternative embodiment of a distributing means 12, in which, an elliptical disc is provided with recesses to form a propeller blade 16 or similar means, by which wood fibers can be transported in a desired direction. Thus, the distributing means 12 according to this embodiment extend only partly around the axle 11. It is also possible to alter the shape of different distributing means 12, according to this embodiment, to provide different properties along the axle 11, in such a way that a desired distribution is obtained.

Figure 7:
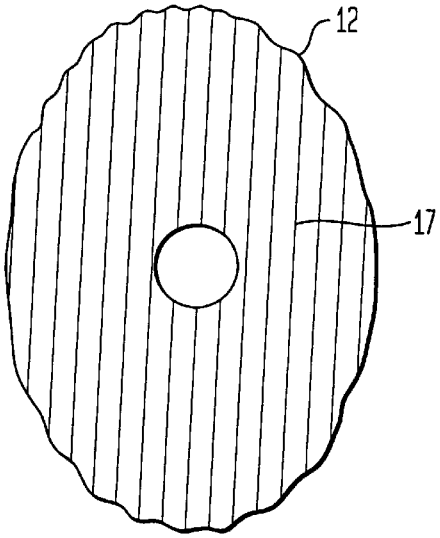
FIG. 7 is a side, elevational, schematic view of another embodiment of a distribution means according to the present invention.

FIG. 7 shows a fourth alternative embodiment of a distributing means 12, in which an elliptical disc is provided with corrugations 17 or similar surface structure, to convey the wood fibers. The corrugations 17 can also be shaped in such a way that some propeller-type action is created for transportation of the wood fibers in a desired direction.

Figure 8:
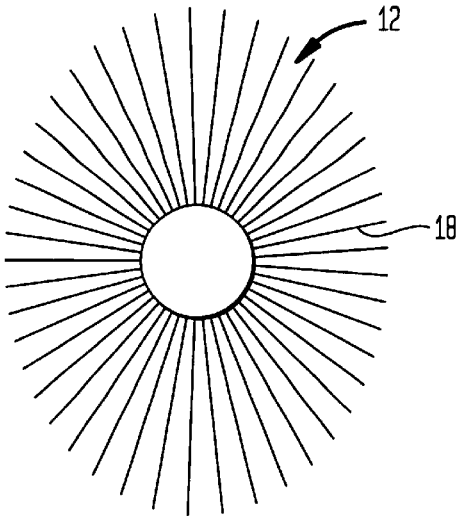
FIG. 8 is a side, elevational, schematic view of another embodiment of a distribution means according to the present invention.

FIG. 8 shows a fifth alternative embodiment of a distributing means 12, in which, a number of protruding pins 18 or similar structure forms an elliptical planar brush, to convey the wood fibers.

Figure 9:
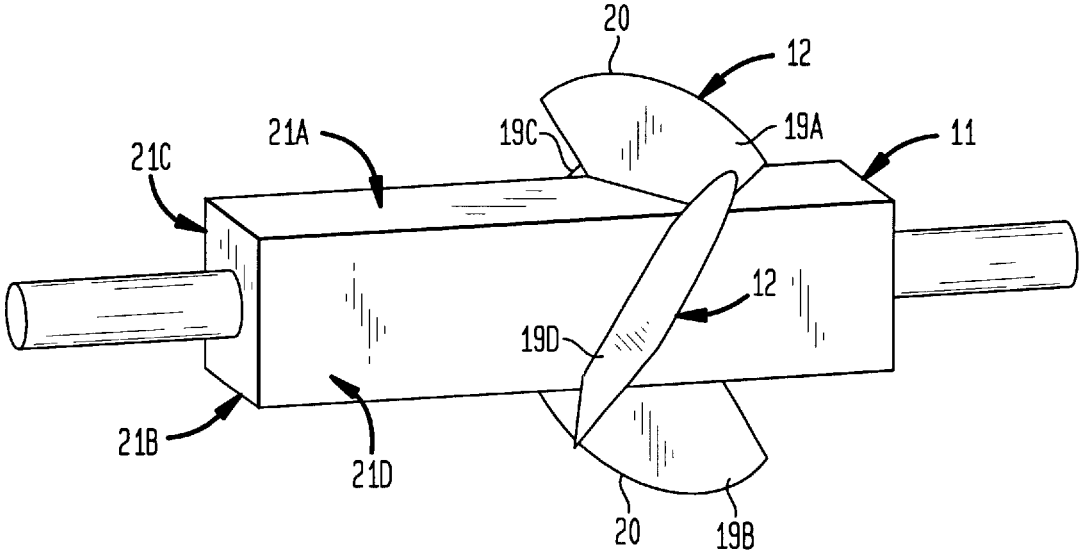
FIG. 9 is a front, elevational, schematic view of another embodiment of a distribution means mounted on an axle according to the present invention.

FIG. 9 shows a sixth alternative embodiment of a distributing means 12, in which, propeller blades, 19A–19D, or similar means are arranged along an axle 11, which in this embodiment has a rectangular cross-section. The outer edge

20 of two propeller blades, 19A and 19B, and, 19C and 19D, respectively, located on opposite sides, 21A and 21B, and, 21C and 21D, respectively, of the axle 11, extend along a common elliptical path. In this embodiment the elliptical path of the propeller blades, 19A and 19B, are arranged at an angle with respect to the elliptical path of the propeller blades, 19C and 19D.In this manner, it is possible to locate the distribution means 12 closer, and it is also possible to alter the shape of different distributing means 12, according to this embodiment, to achieve different properties along the axle 11, in such a way that a desired distribution is obtained.

The axles, 11*a*–11*f*, are arranged at an angle with respect to the material web 9, in such a way that several layers, 13*a*–13*f*, are formed above each other, the thickness of these layers, and thus the thickness of the resulting material web 9 will be defined by that angle.

In the figures the distribution means 12 are directed in the same direction for the different axles 11, but within the framework of the present invention, they may also be directed in different directions.

It is also possible to adjust the inclination of the frame 10 at an angle transverse to the material web 9, in such a way that the resulting cross-sectional profile of the material web will have a desired shape. By securing the axles, 11*a*–11*f*, in the frame 10, in an adjustable manner, in which each axle, 11*a*–11*f*, is individually adjustable vertically, it is possible to influence the thickness of respective layers, 13*a*–13*f*. This is especially important for the uppermost located forming roller, to influence the thickness of the uppermost layer 13*f*.

Naturally, the axles, 11*a*–11*f*, may also be displaced individually, longitudinally of the material web, to provide different distances between said axles, 11*a*–11*f*, or an inclination of respective axles, 11*a*–11*f*, and by that influence the distribution of the wood fibers within respective layers, 13*a*–13*f*.

An additional opportunity to influence the distribution of the wood fibers within respective layer, 13*a*–13*f*, is that the axles, 11*a*–11*f*, are themselves individually adjustable. Thus, each axle, 11*a*–11*f*, is shaped, in a known manner, such that the axle during operation has a deflection in a certain direction.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for spreading and distributing particles onto a moving web of said particles carried by a moving belt and moving in a predetermined direction, said apparatus comprising a plurality of rotatable axles disposed transverse to said predetermined direction, each of said plurality of rotatable axles including a plurality of distributors rotatable with said corresponding plurality of rotatable axles and disposed generally obliquely with respect to said plurality of rotatable axles, each of said plurality of rotatable axles disposed at successively increasing heights from said moving web in said predetermined direction, whereby each of said plurality of distributors extends into said particles comprising said moving web and distributes said particles across said moving web.

2. The apparatus of claim 1 wherein said particles comprise glue-coated wood fibers for production of wood fiberboard.

3. The apparatus of claim 1 including a common frame, each of said plurality of rotatable axles being attached to said common frame, said common frame being disposed at a predetermined angle with respect to said moving web, whereby each of said plurality of rotatable axles provides a layer of said particles having a predetermined thickness, said predetermined thickness being determined by said predetermined angle of said common frame.

4. The apparatus of claim 3 wherein said common frame is adjustable in a direction transverse to said predetermined direction at a predetermined transverse angle, whereby the cross-sectional profile of said particles comprising said moving web can be altered by altering said predetermined transverse angle.

5. The apparatus of claim 3 wherein each of said plurality of rotatable axles is individually vertically adjustably attached to said common frame, whereby said predetermined thickness of each of said layers of said particles can be adjusted.

6. The apparatus of claim 3 wherein each of said plurality of rotatable axles is individually longitudinally adjustably attached to said common frame, whereby the distance between said plurality of rotatable axles can be altered so as to alter the angle between said plurality of rotatable axles and the distribution of said particles within said layer.

7. The apparatus of claim 1 wherein at least one of said plurality of distributors comprises an elliptical disk.

8. The apparatus of claim 7 wherein said elliptical disk includes at least one opening, whereby said particles can pass therethrough.

9. The apparatus of claim 8 wherein said elliptical disk includes a plurality of said openings, and including at least one spoke separating said plurality of openings.

10. The apparatus of claim 9 wherein said at least one spoke is shaped in a manner whereby said particles are transported by said at least one shaped spoke in a predetermined direction.

11. The apparatus of claim 1 wherein at least one of said distributors includes transport means disposed on the periphery thereof, whereby said particles are transported in a predetermined direction by said transport means.

12. The apparatus of claim 11 wherein said transport means comprises protrusions.

13. The apparatus of claim 1 wherein at least one of said distributors comprises an elliptical disk including at least one recess, said elliptical disk formed in a manner whereby said particles are transported in a predetermined direction thereby.

14. The apparatus of claim 1 wherein at least one of said distributors comprises an elliptical disk including corrugations, whereby said particles are transported in a predetermined direction thereby.

15. The apparatus of claim 1 wherein at least one of said distributors comprises a plurality of protruding members, whereby said particles are transported in a predetermined direction thereby.

16. The apparatus of claim 15 wherein said protruding members are disposed in the shape of an elliptical planar brush.

17. The apparatus of claim 16 wherein said protruding members comprises a plurality of protruding pins.

* * * * *